US006739222B2

(12) United States Patent
Hsieh

(10) Patent No.: US 6,739,222 B2
(45) Date of Patent: May 25, 2004

(54) RATCHET SOCKET

(76) Inventor: Chih-Ching Hsieh, No. 367-1, Pei Yang Road, Feng Yuan City, Taichung Hsien (TW)

( * ) Notice: Subject to any disclaimer, the term of this patent is extended or adjusted under 35 U.S.C. 154(b) by 0 days.

(21) Appl. No.: 10/190,531

(22) Filed: Jul. 9, 2002

(65) Prior Publication Data

US 2004/0007098 A1 Jan. 15, 2004

(51) Int. Cl.[7] ..... B25B 13/46
(52) U.S. Cl. ..... 81/60; 81/63.1
(58) Field of Search ..... 81/60–63.2; 192/41 R, 192/43.2

(56) References Cited

U.S. PATENT DOCUMENTS 790,168 A * 5/1905 Baldwin ..... 81/61
4,328,720 A * 5/1982 Shiel ..... 81/63
4,934,226 A * 6/1990 Dacey, Jr. ..... 81/125
5,687,623 A 11/1997 Hsieh ..... 81/60
6,357,323 B2 * 3/2002 Chi et al. ..... 81/60
6,397,705 B1 * 6/2002 Hsieh ..... 81/63.1

* cited by examiner

*Primary Examiner*—D. S. Meislin
(74) *Attorney, Agent, or Firm*—Troxell Law Office PLL

(57) ABSTRACT

Ratchet socket for fitting onto a screwed member. The ratchet socket is drivable by a tool to wrench the screwed member. The ratchet socket includes: a cylindrical main body formed with at least one internal circular hole and at least one through hole formed on the circumference of the main body and communicating with the circular hole; and a ratchet mechanism including a ratchet wheel rotatably disposed in the circular hole, a dog member movably accommodated in the through hole and a resilient hoop fitted around the main body to exert a resilient force onto the outer side of the dog member, keeping the dog member resiliently engaged with the ratchet wheel. When the dog member is engaged with the ratchet wheel, the ratchet mechanism provides a ratchet effect and the main body of the socket is one-way drivingly engaged with the ratchet wheel.

16 Claims, 11 Drawing Sheets

RATCHET SOCKET

BACKGROUND OF THE INVENTION

The present invention is related to a hand tool, and more particularly to a ratchet socket which is easy to assemble and has simplified structure and can be conveniently used.

A socket can be fitted with a handle to form a socket wrench. One end of the socket is inserted with the handle, while the other end of the socket can be fitted onto a screwed member such as a nut or a bolt for wrenching the same. In conventional structure, the socket does not provide ratchet effect.

U.S. Pat. No. 5,687,623 of this inventor, entitled "reversible socket wrench" discloses a socket capable of providing ratchet effect (one-way rotation) to facilitate use of the socket wrench.

Such socket has complicated structure and includes many small parts which are uneasy to manufacture and assemble. Accordingly, the volume of the socket is enlarged. This leads to inconvenience in use.

SUMMARY OF THE INVENTION

It is therefore a primary object of the present invention to provide a ratchet socket which has simple structure and is easy to manufacture and assemble.

The present invention can be best understood through the following description and accompanying drawings wherein:

DETAILED DESCRIPTION OF THE PREFERRED EMBODIMENTS

Figure 1:
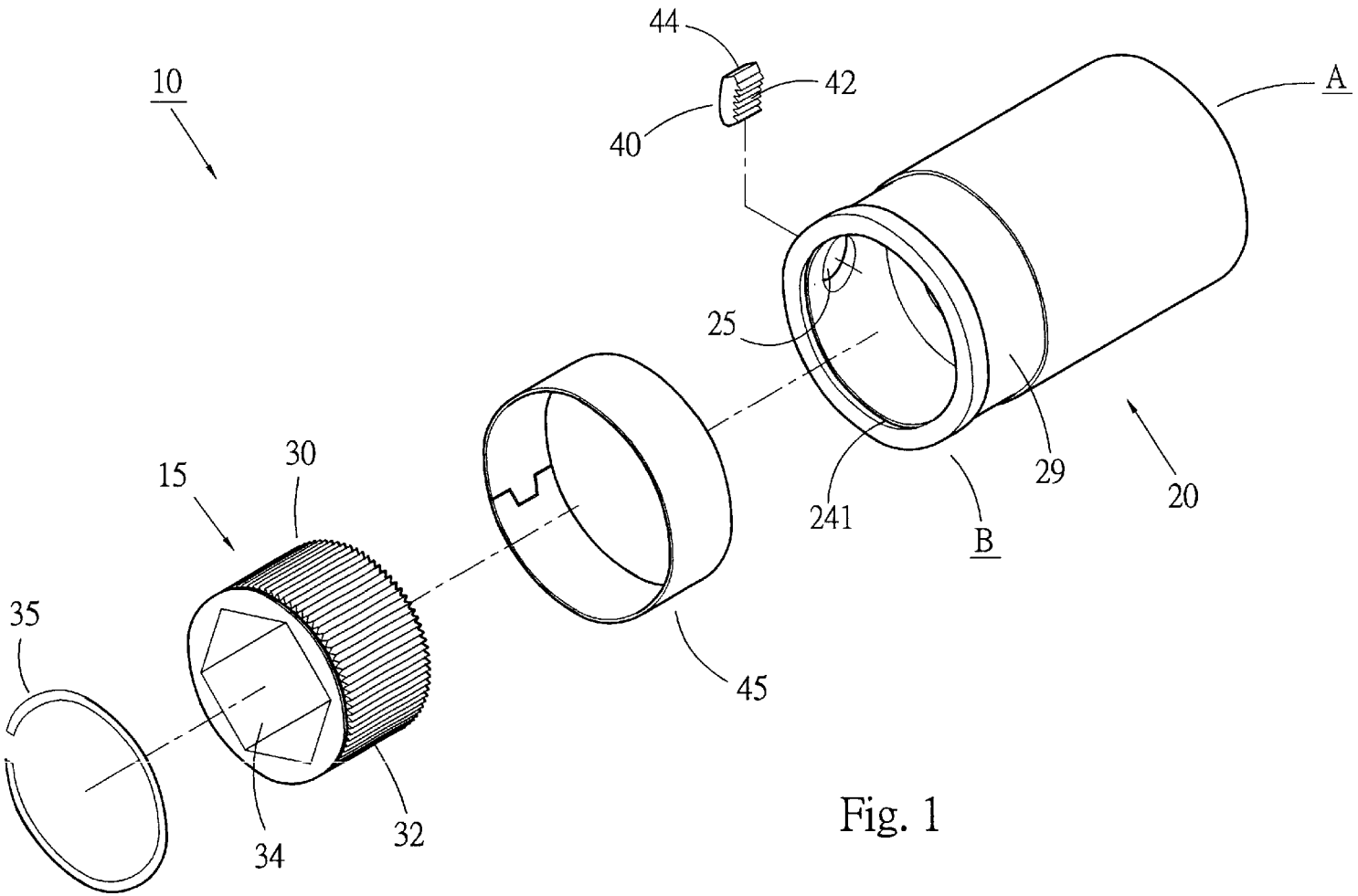
FIG. 1 is a perspective exploded view of a first embodiment of the present invention.
Figure 2:
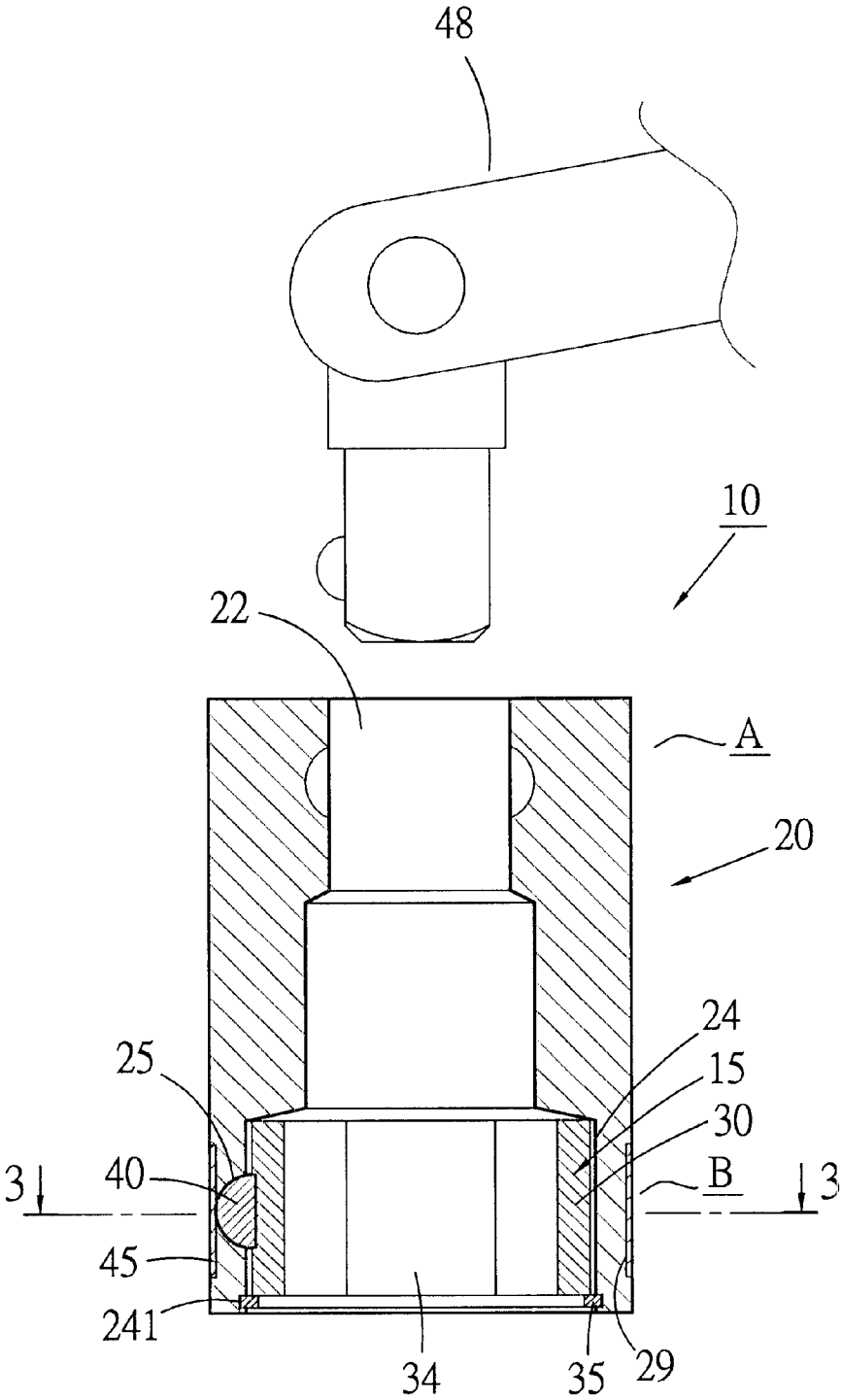
FIG. 2 is a longitudinal sectional assembled view according to FIG. 1.
Figure 3:
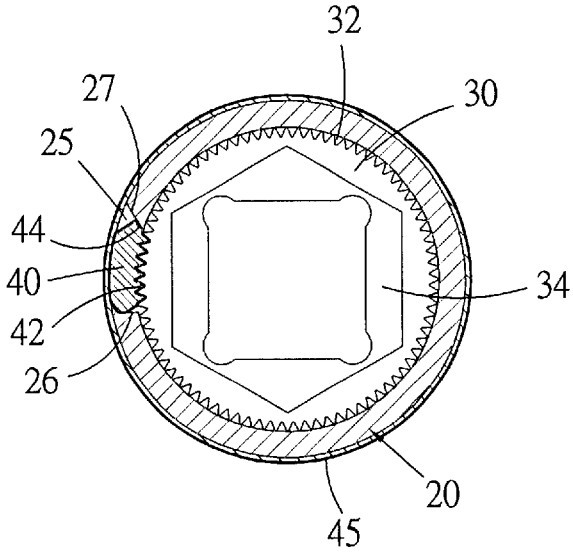
FIG. 3 is a sectional view taken along line 3—3 of FIG. 2.

Please refer to FIGS. 1 to 3. According to a first embodiment, the ratchet socket 10 of the present invention includes a cylindrical main body 20 and a ratchet mechanism 15.

One end of the main body 20 is a driving end A formed with a polygonal insertion hole 22 for a handle or other tool to insert therein. The other end is a wrenching end B formed with a circular hole 24. The circumferential wall of the circular hole 24 is formed with a throughhole 25 communicating with the circular hole. As shown in FIG. 3, one side of the through hole 25 has a straight abutting face 26, while the other side thereof has a slope face 27. A gap between the slope face and the abutting face is inward tapered.

The ratchet mechanism 15 includes:

- a ratchet wheel 30, the circumferential face of the ratchet wheel 30 being formed with continuous teeth 32, the ratchet wheel 30 being formed with inner polygonal fitting hole 34 such as hexagonal or dodecagonal fitting hole in accordance with the profile of the nut or the bolt, the ratchet wheel 30 being rotatably positioned in the circular hole 24 of the main body, a C-shaped retainer ring 35 being inlaid in an annular groove 241 formed on an outer end of the circular hole for avoiding detachment of the ratchet wheel 30;
- a dog member 40 accommodated in the through hole 25, an inner end of the dog member being formed with multiple teeth 42 for engaging with the teeth 32 of the ratchet wheel, one side of the dog member 40 abutting against the abutting face 26, while the other side of the dog member contacting with the slope face 27, a slope section 44 being formed on the side of the dog member in contact with the slope face for snugly attaching to the slope face 27, however, the slope section being omissible; and
- a resilient hoop 45 inlaid in an annular groove 29 formed along outer circumference of the main body 20, the resilient hoop 45 covering outer side of the dog member 40 to exert a resilient force thereto, whereby in normal state, the dog member is kept engaging with the ratchet wheel.

In use of the socket 10, as shown in FIG. 2, a handle 48 or another suitable tool is inserted into the insertion hole 22 of the main body 20. The fitting hole 34 of the ratchet wheel 30 is fitted onto a screwed member. By means of turning the handle 48, the socket is driven to wrench the screwed member.

Figure 4:
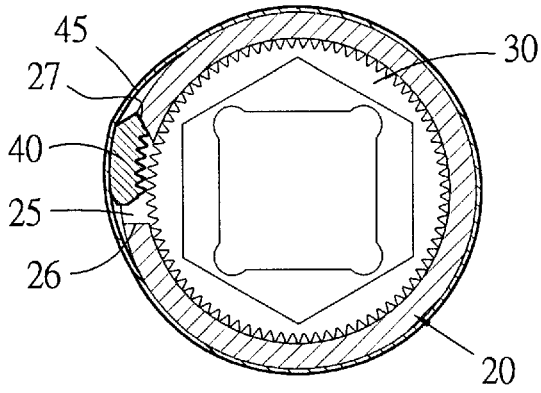
FIG. 4 is a view according to FIG. 3, showing another operation state.

FIGS. 3 and 4 show the operation of the socket. In FIG. 3, when clockwise turning the main body 20, the ratchet wheel 30 suffers a counterclockwise resistance of the screwed member. At this time, the dog member 40 is rightward driven by the ratchet wheel to abut against the straight abutting face 26 without displacing outward. Under such circumstance, the dog member is kept engaging with the ratchet wheel without detachment. By means of the engagement, the main body 20 can drive the ratchet wheel to clockwise rotate for wrenching the screwed member.

Reversely, referring to FIG. 4, when counterclockwise turning the main body 20, the ratchet wheel 30 suffers a clockwise resistance of the screwed member. At this time, the dog member 40 is leftward driven by the ratchet wheel to lean on the slope face 27. The dog member 40 is guided by the slope face 27 to move outward. Under such circumstance, the dog member is disengaged from the ratchet wheel. Therefore, when counterclockwise rotated, the main body 20 cannot drive the ratchet wheel to wrench the screwed member.

In FIG. 4, after the dog member is released from the pushing force of the ratchet wheel, the resilient hoop 45 resiliently restores the dog member to its home position as shown in FIG. 3.

According to the above arrangement, the socket provides a ratchet effect, that is, a one-way driving effect.

Figure 5:
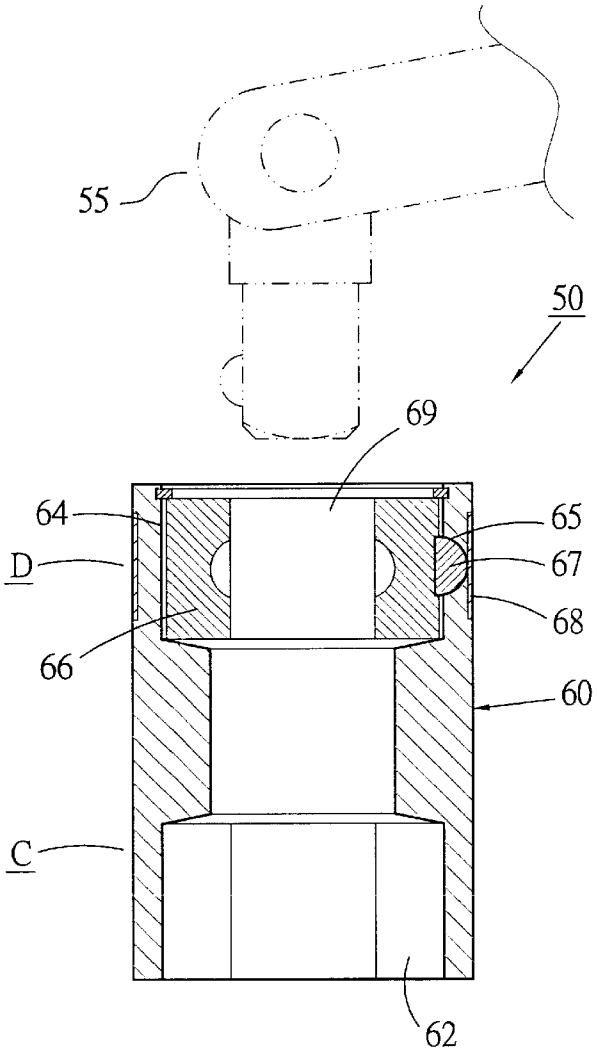
FIG. 5 is a longitudinal sectional view of a second embodiment of the present invention.

FIG. 5 shows a second embodiment of the present invention. The wrenching end C of the main body 60 of the socket 50 is formed with a polygonal fitting hole 62 for fitting with a screwed member. The other end of the main body 60 is a driving end D. The ratchet mechanism (identical to that of the first embodiment) is disposed in the driving end. The driving end D is formed with a circular hole 64 and a through hole 65. The ratchet wheel 66 and the dog member 67 are placed in the circular hole 64 and the through hole 65 and engaged with each other. A resilient hoop 68 resiliently presses the dog member 67. The ratchet wheel 66 is formed with a polygonal insertion hole 69 for connecting with a driving tool.

In this embodiment, the ratchet mechanism is disposed in the driving end D instead of the wrenching end C. In use of the socket 50, the fitting hole 62 is fitted onto the screwed member, while a handle 55 or another suitable tool is inserted into the insertion hole 69 of the ratchet wheel 66. Accordingly, by means of turning the handle 55, the socket also can provide a ratchet effect for one-way wrenching the screwed member.

Figure 6:
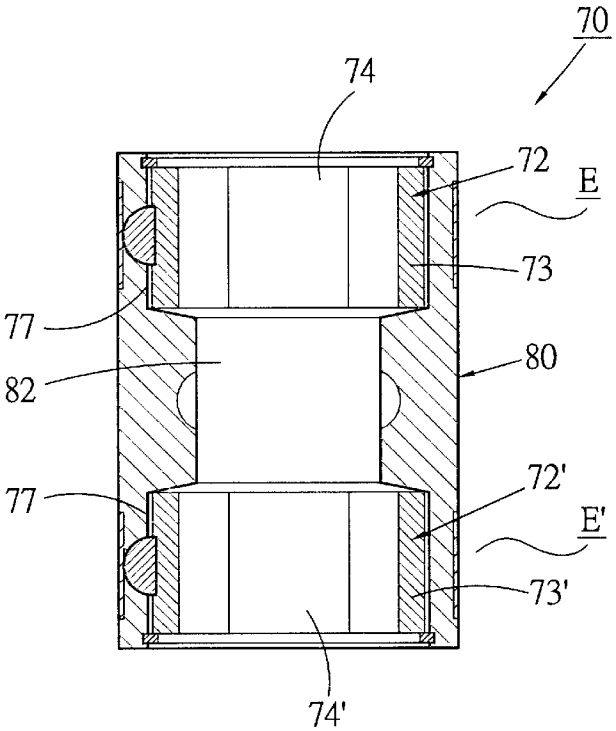
FIG. 6 is a longitudinal sectional view of a third embodiment of the present invention.

FIG. 6 shows a third embodiment of the present invention, in which two ends of the main body 80 of the socket 70 are both wrenching ends E, E'. Each wrenching end is disposed a ratchet mechanism 72 identical to that of the first embodiment) therein to provide ratchet effect. This embodiment is characterized in that the two ratchet wheels 73, 73' provide one-way driving effect in different rotational directions. The center of the main body 80 is additionally formed with a polygonal insertion hole 82 communicating with the circular holes 77 at two ends of the main body. The insertion hole serves as an insertion section.

Figure 7:
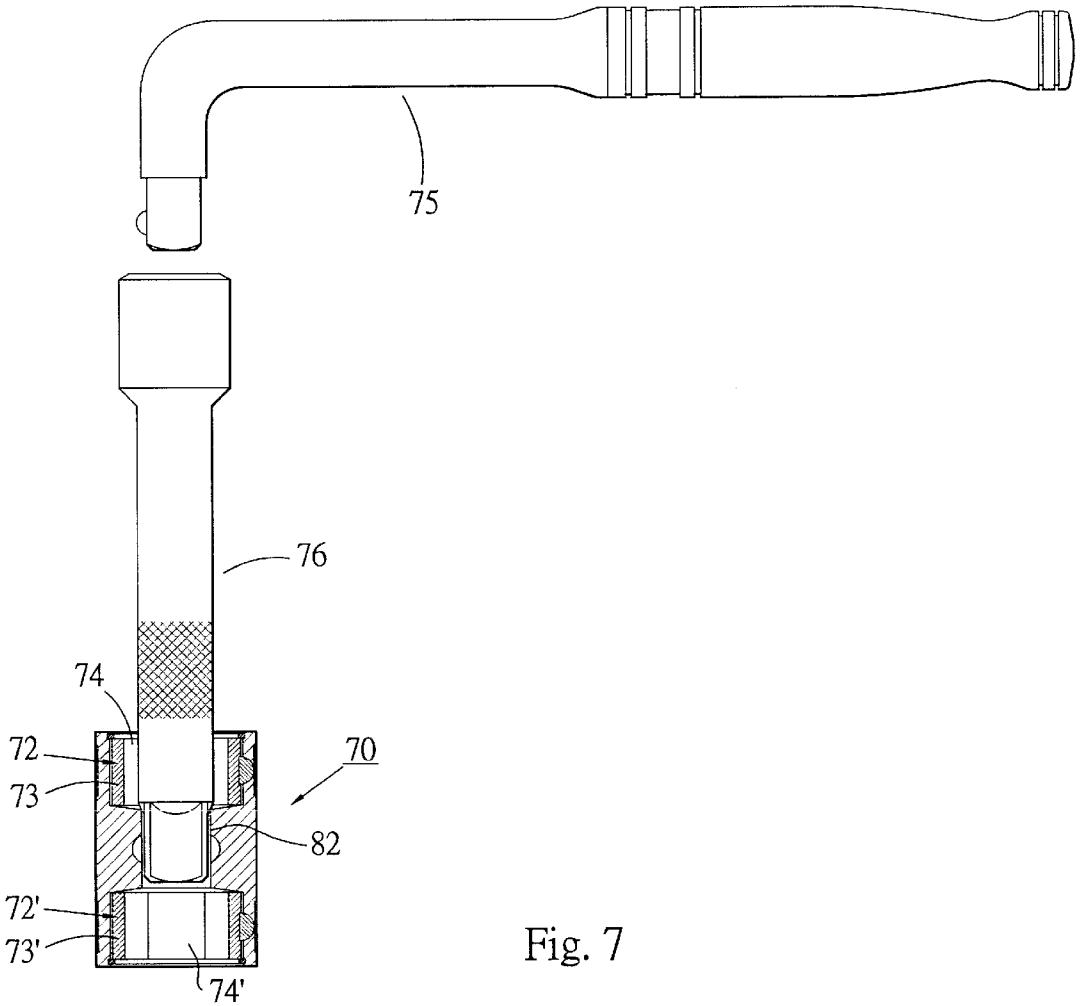
FIG. 7 shows the use of the embodiment of FIG. 6.

In use, as shown in FIG. 7, the handle 75 can be passed through the fitting hole 74 of either ratchet wheel 73 and inserted into the insertion hole 82 for operating the socket 70. The fitting hole 74' of the other ratchet wheel 73' is fitted onto a screwed member. Accordingly, a user can selectively use one of the ratchet wheels to wrench the nut as necessary. One of the ratchet wheel has a rotational direction for tightening the screwed member, while the other ratchet wheel has a rotational direction for untightening the screwed member.

It should be noted that in the case that it is impossible to directly insert a handle into the insertion hole, the handle can be used in cooperation with a connecting rod 76. The connecting rod 76 is inserted into the insertion hole and the handle 75 is connected with the connecting rod 76.

Figure 8:
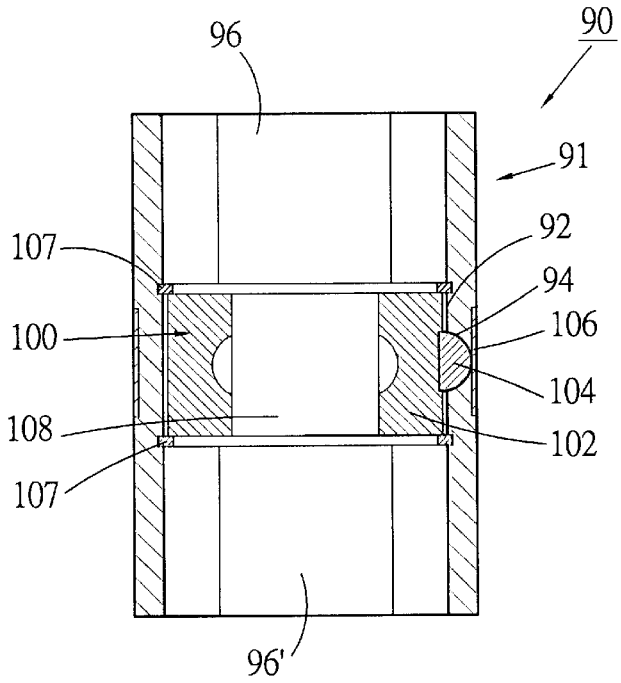
FIG. 8 is a longitudinal sectional view of a fourth embodiment of the present invention.

FIG. 8 is a sectional view showing a fourth embodiment of the socket 90 of the present invention, in which the middle section of the main body 91 is formed with a circular hole 92 and a through hole 94. Two ends of the main body are both wrenching ends each having a polygonal fitting hole 96 communicating with the circular hole 92. The two fitting holes have identical sizes for fitting onto screwed members with equal sizes.

The ratchet mechanism 100 (identical to that of the first embodiment) is disposed in the middle section of the main body. The ratchet wheel 102 and the dog member 104 are respectively placed in the circular hole and the through hole. A resilient hoop 106 resiliently presses the dog member 104. The ratchet wheel 102 is fixed by C-shaped retainer rings 107 and is formed with a polygonal insertion hole 108. Accordingly, the middle section of the main body serves as a driving section.

In use, the handle or tool is passed through the fitting hole 96 and inserted into the insertion hole 108. The other fitting hole 96' is fitted onto a screwed member for wrenching (tightening) the same. Reversely, the handle or tool can be passed through the fitting hole 96' and inserted into the insertion hole 108. The fitting hole 96 is fitted onto a screwed member for wrenching (untightening) the same in reverse direction.

Figure 9:
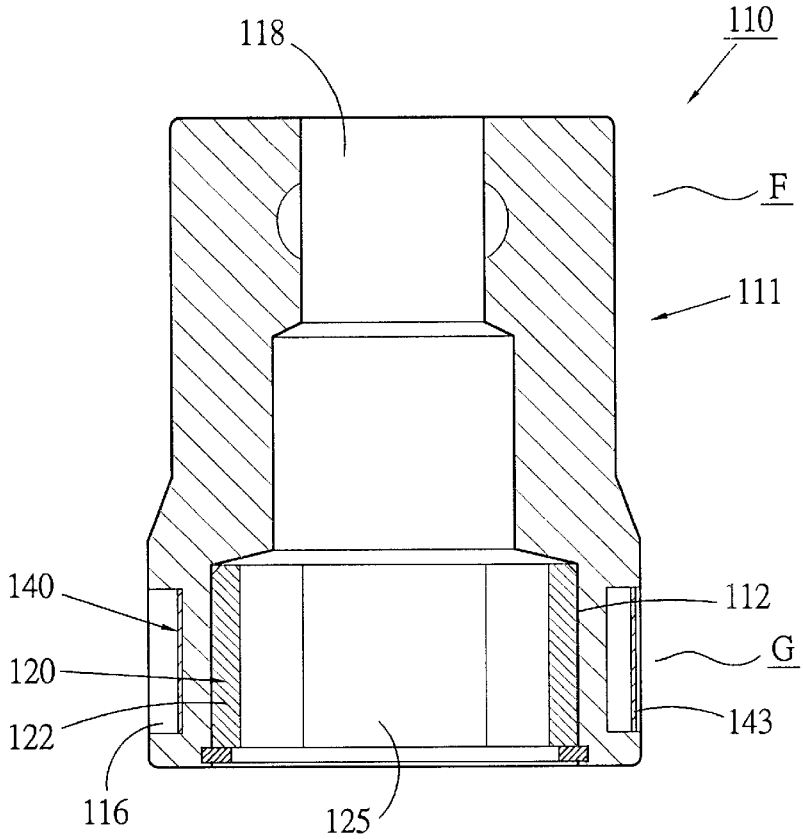
FIG. 9 is a longitudinal sectional view of a fifth embodiment of the present invention.
Figure 10:
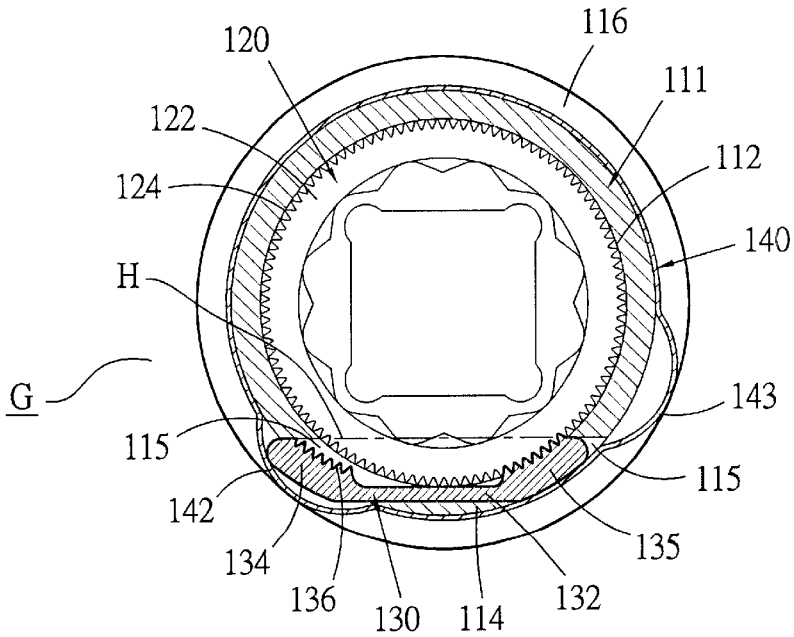
FIG. 10 is a cross-sectional view according to FIG. 9.

FIGS. 9 and 10 show a fifth embodiment of the present invention. One end of the socket 110 is a driving end F, while the other end thereof is a wrenching end G. The ratchet mechanism 120 is disposed in the wrenching end G. The rotational direction of the ratchet mechanism is changeable in a manner as follows:

The wrenching end G of the main body 111 is formed with a circular hole 112. A through hole H as shown by the phantom line from one side to the other side passes through a section of the main body near the outer circumference thereof. The through hole H communicates with the circular hole 112. A solid section 114 remains on outer side of the through hole H.

The ratchet mechanism 120 includes a ratchet wheel 122, a dog member 130 and a resilient hoop 140. When the ratchet wheel 122 is mounted in the circular hole 112, two ends of the through hole H are defined to form two larger spaces 115, while a slender gap is defined between the ratchet wheel and the solid section 114.

The dog member 130 has an elongated body 132 and two engaging sections 134, 135 at two ends of the elongated body 132. The inner sides of the engaging sections are formed with multiple teeth 136 for engaging with the teeth 124 of the ratchet wheel. The dog member 130 is accommodated in the through hole H with the two engaging sections 134, 135 respectively positioned in the spaces 115. The elongated body 132 is positioned in the slender gap. The distance between the two engaging sections is larger than the distance between the two spaces 115, whereby two engaging sections will not engage with the ratchet wheel at the same time.

The resilient hoop 140 is inlaid in an annular groove 116 formed along outer circumference of the main body 111. The resilient hoop 140 has two outward convex sections 142, 143. The distance between the two convex sections 142, 143 is larger than the distance between the two engaging sections 134, 135.

In use, as shown in FIG. 10, the resilient hoop 140 is turned to make the outward convex section 142 right in the position of the engaging section 134, while making the other outward convex section 143 away from the other engaging section 135. At this time, the body of the resilient hoop 140 resiliently presses the engaging section 135 to make the engaging section 135 retract into the space 115 and engage with the ratchet wheel 122. The engaging section 134 is moved outward from the other space 115 into the outward convex section 142 and disengaged from the ratchet wheel.

In the state of FIG. 10, when counterclockwise turning the main body 111, the ratchet wheel is synchronously rotated to wrench the screwed member fitted with the ratchet wheel.

The solid section 114 serves as a section for supporting the dog member 130.

Figure 11:
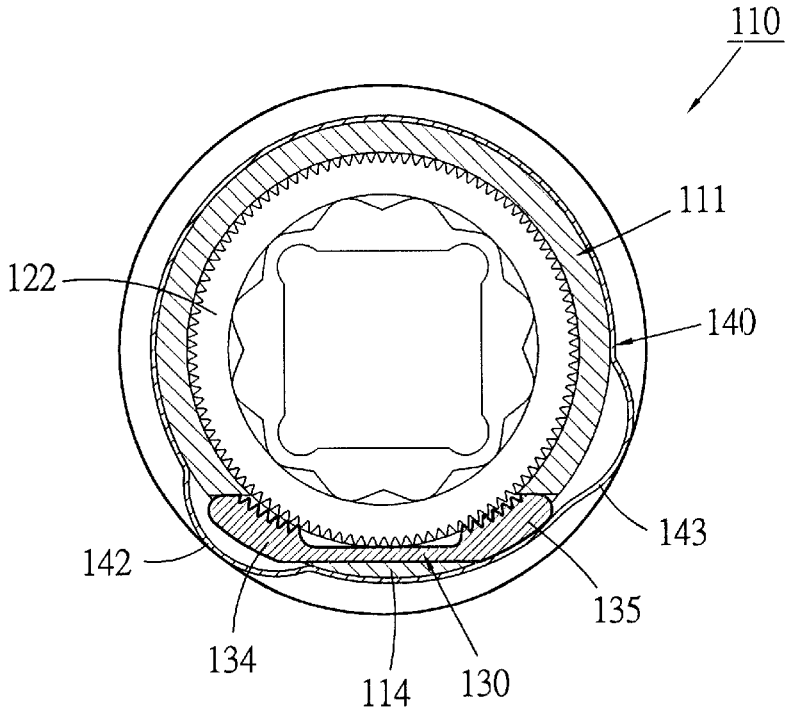
FIG. 11 is a view according to FIG. 10, showing another operation state.

Reversely, when clockwise turning the main body 111, the ratchet wheel 122 suffers a resistance of the screwed member and the dog member 130 is driven to move rightward. At this time, the engaging section 135 is disengaged from the ratchet wheel as shown in FIG. 11 and the other engaging section 134 is still not yet engaged with the ratchet wheel. Therefore, when clockwise rotating the main body, the ratchet wheel and the screwed member will not be rotated. Accordingly, the socket 110 provides a one-way driving effect. When the dog member is released from the rightward pushing force of the ratchet wheel, the resilient hoop 140 resiliently leftward pushes the dog member and restores the same into the state as shown in FIG. 10.

Figure 12:
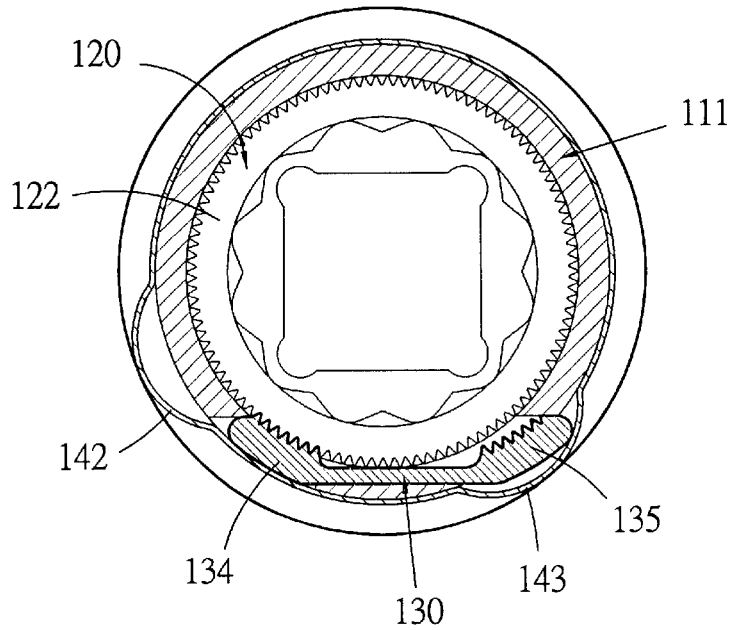
FIG. 12 shows that the dog member is switched to another position.

When the resilient hoop 140 is turned to a state of FIG. 12, the dog member 130 is switched to another position and the engaging section 135 is moved into the outward convex section 143 and is not engaged with the ratchet wheel 122. The resilient hoop 140 resiliently presses the engaging section 134 to make the same engaged with the ratchet wheel 122. At this time, when clockwise turning the socket, the main body 111 drives the ratchet wheel to rotate for wrenching the screwed member.

Reversely, when counterclockwise turning the socket, the ratchet wheel is not rotated along with the main body. Accordingly, in the state of FIG. 12, the socket provides a ratchet effect in another direction.

It should be noted that in the embodiment of FIG. 9, the ratchet wheel 122 is formed with a polygonal fitting hole 125 for fitting with a screwed member. Therefore, the end of the main body equipped with the ratchet mechanism serves as the wrenching end G, while the other end of the main body is formed with an insertion hole 118 for fitting with a handle and serves as the driving end F. However, the driving end and the wrenching end can be switched. That is, the ratchet wheel is formed with a polygonal insertion hole for insertion of the handle. Accordingly, the end of the main body equipped with the ratchet mechanism serves as the driving end, while the other end of the main body free from the ratchet mechanism is formed with a fitting hole for fitting with a nut and serves as the wrenching end.

Figure 13:
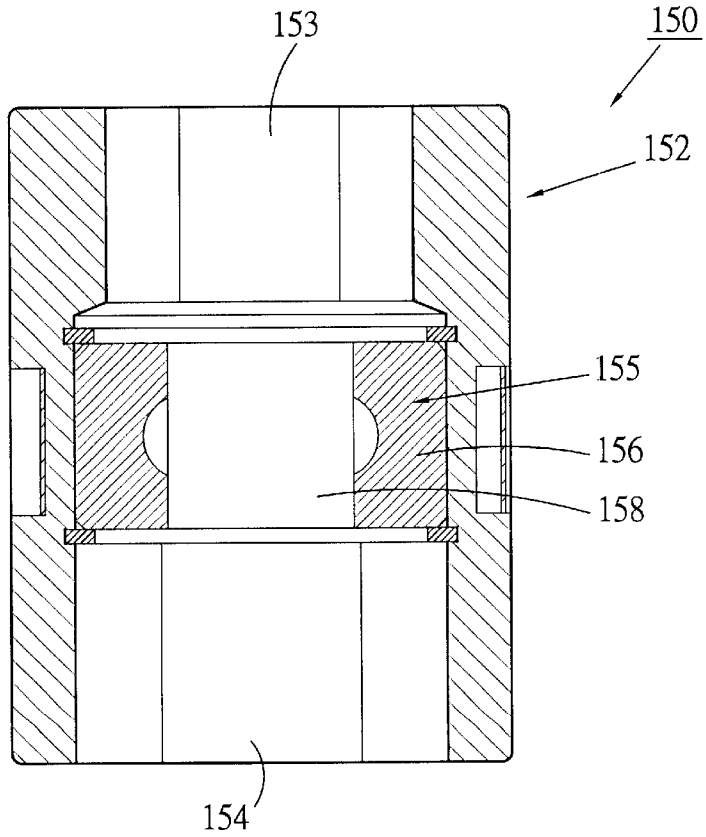
FIG. 13 is a longitudinal sectional view of a sixth embodiment of the present invention.

FIG. 13 is a longitudinal sectional view of a sixth embodiment of the socket 150 of the present invention. The ratchet mechanism 155 is identical to that of FIGS. 9 and 10 and is disposed in the middle section of the main body 152. The ratchet wheel 156 is formed with a polygonal insertion hole 158, whereby the middle section of the socket serves as a driving section. Two ends of the main body 152 are wrenching ends each having a polygonal fitting hole 153, 154. The two fitting holes have different sizes.

In use, a handle or a tool is inserted into the insertion hole 158 to drive and turn the socket for wrenching the screwed member. The rotational directions of the ratchet mechanism 155 are switchable so that the fitting holes 153, 154 can have different sizes for fitting with different sizes of screwed members.

Figure 14:
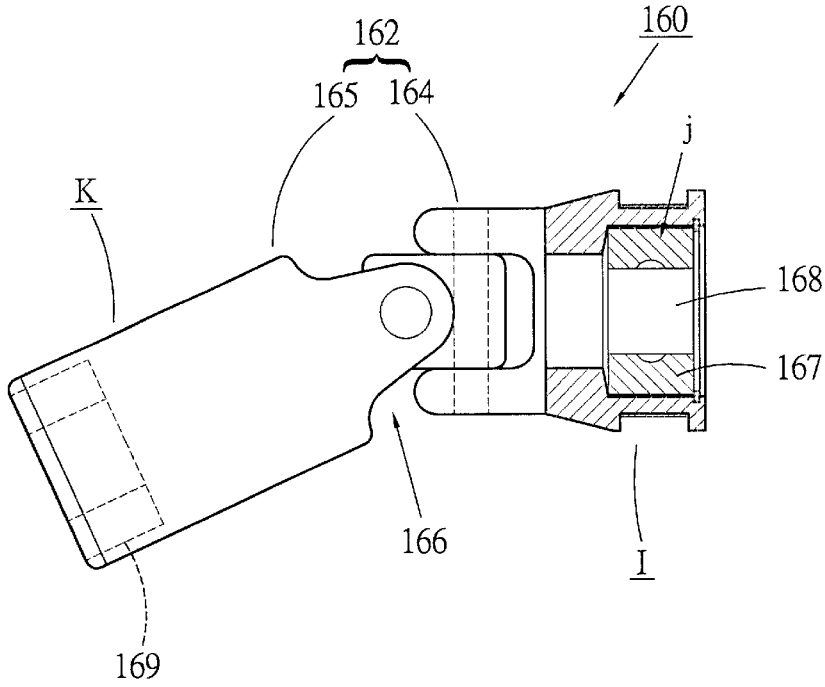
FIG. 14 is a sectional view of a seventh embodiment of the present invention, showing the structure thereof.

FIG. 14 shows a seventh embodiment of the present invention, in which the main body 162 of the socket 160 is composed of two halves 164, 165 pivotally connected with each other by a universal joint 166. The two halves can be bent by any angle. One end of one half 164 serves as a driving end I equipped with a ratchet mechanism j of any of the above embodiments. The ratchet wheel 167 of the ratchet mechanism is formed with a polygonal insertion hole 168 for insertion of a handle or a tool. One end of the other half 165 is formed with a polygonal fitting hole 169 and serves as a wrenching end K for fitting with a screwed member.

Figure 15:
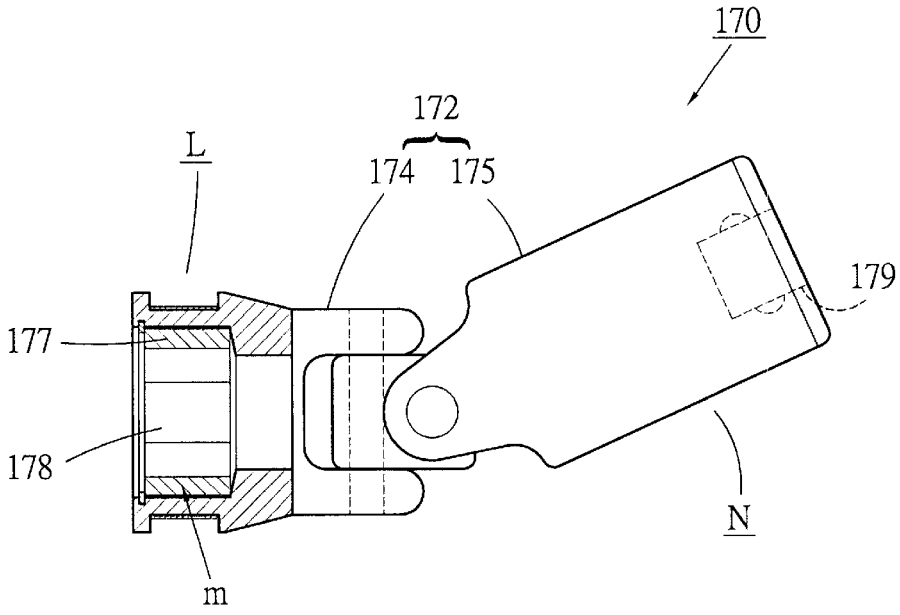
FIG. 15 is a sectional view of an eighth embodiment of the present invention, showing the structure thereof.

FIG. 15 shows an eighth embodiment of the present invention substantially identical to FIG. 14. The main body 172 of the socket 170 is also composed of two halves 174, 175 pivotally connected with each other. One end of one half 174 serves as a wrenching end L in which a ratchet mechanism m is disposed. The ratchet mechanism can be the ratchet mechanism of any of the above embodiments. The ratchet wheel 177 of the ratchet mechanism is formed with a polygonal fitting hole 178 for fitting with a nut. One end of the other half 175 is formed with a polygonal insertion hole 179 and serves as a driving end N for insertion of a handle.

Figure 16:
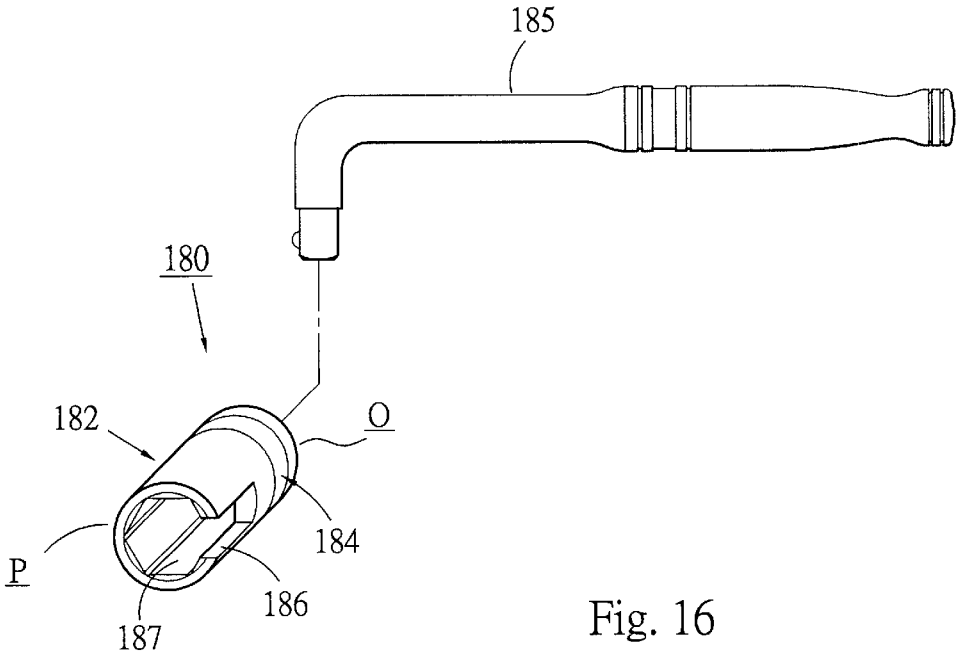
FIG. 16 shows a ninth embodiment of the present invention.

FIG. 16 shows a ninth embodiment of the present invention, in which the main body 182 of the socket 180 has a driving end O and a wrenching end P. The driving end is equipped with a ratchet mechanism 184 which can be the ratchet mechanism of any of the above embodiments. A handle 185 can be inserted in the driving end. In the case that the ratchet mechanism is not disposed in the wrenching end P, the circumference of the wrenching end is formed with a notch 186 communicating with the fitting hole 187. Accordingly, in the case that there is electric wire or cable, when the fitting hole 187 is fitted onto a screwed member, the wire or cable can extend out through the notch 186.

Figure 17:
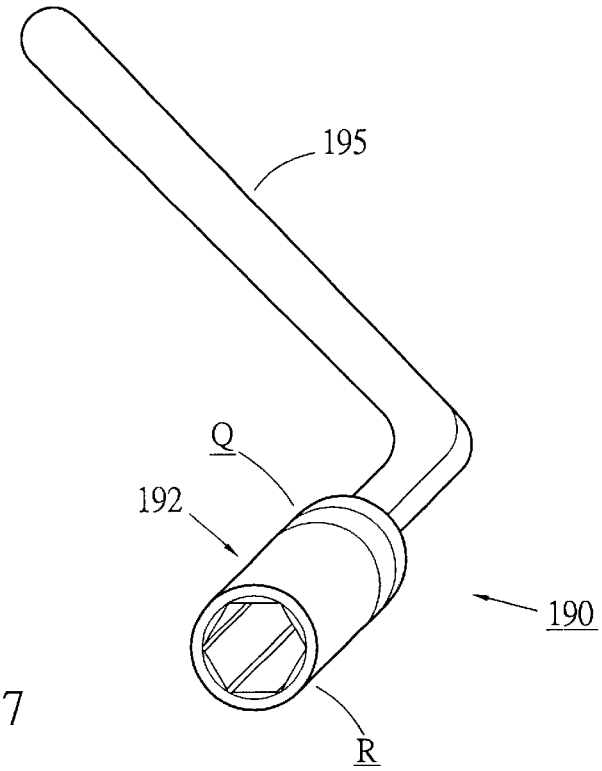
FIG. 17 shows a tenth embodiment of the present invention.

FIG. 17 shows a tenth embodiment of the present invention, in which the socket 190 can be any of the above embodiments except the third, fourth and sixth embodiments of FIGS. 6, 8 and 13. The main body 192 of the socket 190 also has a driving end Q and a wrenching end R. A bar body 195 is directly fixed with the driving end Q to form an integral socket wrench. In the case that the driving end is free from the ratchet mechanism (that is, the ratchet mechanism is disposed in the wrenching end), the bar body 195 is fixedly connected with the main body. In the case that the driving end is equipped with the ratchet mechanism, the bar body is fixedly connected with the ratchet wheel.

Figure 18:
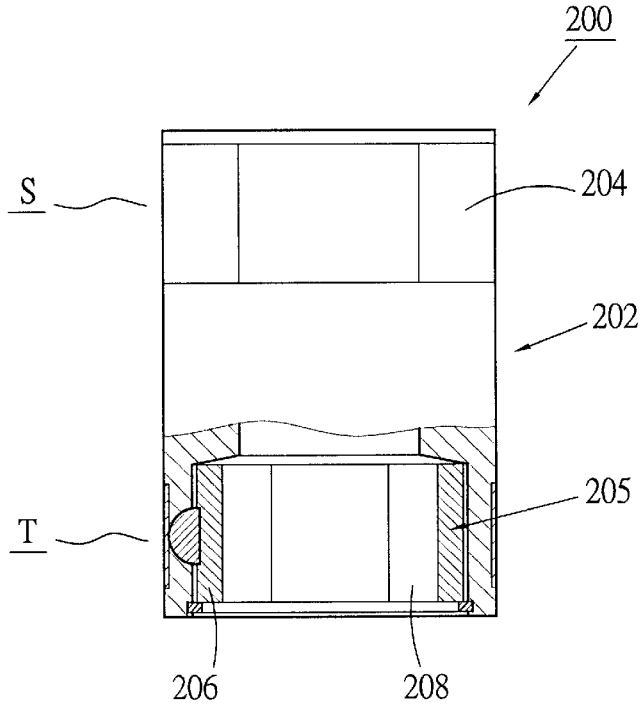
FIG. 18 is a partially sectional view of an eleventh embodiment of the present invention.

FIG. 18 shows an eleventh embodiment of the socket 200 of the present invention, in which one end of the main body 202 of the socket 200 is a driving end S, while the other end thereof is a wrenching end T. A ratchet mechanism 205 which can be one of the embodiments of FIGS. 2 and 9 is disposed in the wrenching end T. The ratchet wheel 206 is formed with a fitting hole 208 for fitting with a screwed member. A polygonal such as hexagonal or square driving section 204 is disposed on the outer circumference of the driving end S. The driving section 204 can be held by an open wrench, adjustable wrench or pincers. Accordingly, the socket can be driven to wrench the screwed member.

Figure 19:
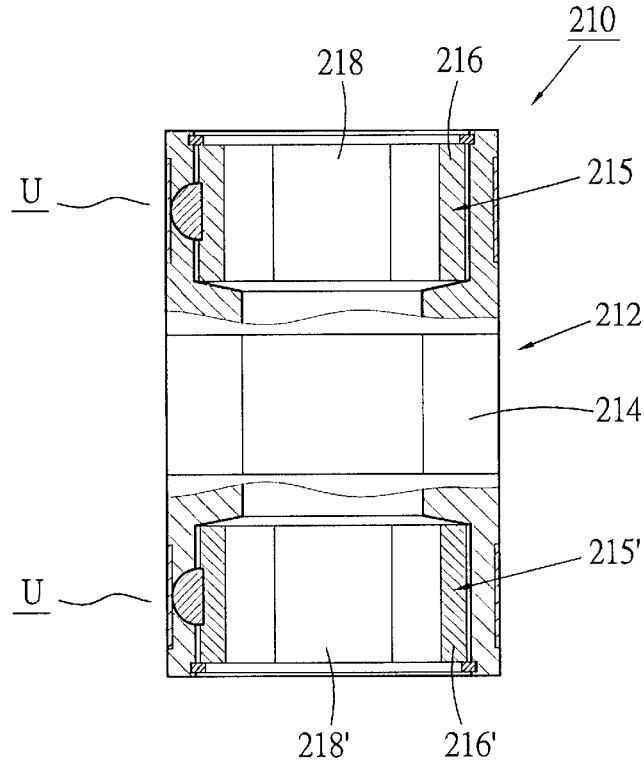
FIG. 19 is a partially sectional view of a twelfth embodiment of the present invention.

FIG. 19 shows a twelfth embodiment of the socket 210 of the present invention, in which two ends of the main body 212 of the socket are wrenching ends U each having a ratchet mechanism 215, 215' which can be the ratchet mechanism of FIG. 2 or FIG. 9. The fitting holes 218, 218' of the ratchet wheels 216, 216' are adapted to fit onto a screwed member. The fitting holes can have identical or different sizes. A hexagonal or square driving section 214 is disposed on the outer circumference of the middle section of the main body 212 for a tool to hold.

The present invention has simple structure and is easy to manufacture and assemble. The socket of the present invention has small volume. The above embodiments are only used to illustrate the present invention, not intended to limit the scope thereof. Many modifications of the above embodiments can be made without departing from the spirit of the present invention.

What is claimed is:

1. Ratchet socket for fitting into a screwed member, the ratchet socket being drivable by a tool to wrench the screwed member, the ratchet socket comprising:

a cylindrical main body; and at least one ratchet mechanism disposed in the main body, the main body being formed with a circular hole and a through hole in which the ratchet mechanism is disposed, the circular hole being formed in the main body, the through hole being formed on the main body corresponding to the circular hole, an outer end of the through hole communicating with outer circumference of the main body, an inner end of the through hole communicating with the circular hole, one side of the through hole being a straight abutting face, the other side of the through hole being a slope face, a gap between the slope face and the abutting face being inward tapered;

said ratchet mechanism including:

a ratchet wheel rotatably disposed in the circular hole, an outer circumference of the ratchet wheel being formed with continuous teeth;

a dog member movably accommodated in the through hole, an inner end of the dog member facing the ratchet wheel and being formed with multiple teeth for engaging With the teeth of the ratchet wheel; and a resilient hoop fitted around outer circumference of the main body to exert a resilient force onto the outer side of the dog member, keeping the dog member resiliently engaged with the ratchet wheel, when the dog member is driven by the ratchet wheel to abut against the abutting face, the dog member is kept engaged with the ratchet wheel, while when the dog member is forced to lean against the slope face, the dog member is moved outward along the slope face to disengage from the ratchet wheel, whereby the ratchet mechanism provides a one-way driving effect.

2. Ratchet socket as claimed in claim 1, wherein the circular hole, through hole and the ratchet mechanism are disposed at one end of the main body.

3. Ratchet socket as claimed in claim 2, wherein the end of the main body equipped with the ratchet mechanism is a wrenching end, the ratchet wheel being formed with a polygonal fitting hole for fitting on a screwed member.

4. Ratchet socket as claimed in claim 3, wherein the other end of the main body is a driving end formed with an insertion hole for a tool or a handle to insert herein.

5. Ratchet socket as claimed in claim 3, wherein the other end of the main body is a driving end, a tool being fixedly connected with the driving end.

6. Ratchet socket as claimed in claim 3, wherein the other end of the main body is a driving end, a polygonal driving section being disposed on outer circumference of the driving end for a tool to hold.

7. Ratchet socket as claimed in claim 2, wherein the end of the main body equipped with the ratchet mechanism is a driving end, the other end of the main body being a wrenching end formed with a polygonal fitting hole for fitting on a screwed member.

8. Ratchet socket as claimed in claim 7, wherein the ratchet wheel is formed with an insertion hole for a tool or a handle to insert therein.

9. Ratchet socket as claimed in claim 7, further comprising a tool fixedly connected with the ratchet wheel.

10. Ratchet socket as claimed in claim 7, wherein the circumference of the wrenching end of the main body is formed with a notch.

11. Ratchet socket as claimed in claim 1, wherein the circular hole, through hole and the ratchet mechanism are disposed at a middle section of the main body, the ratchet wheel of the ratchet mechanism being formed with an insertion hole, two ends of the main body being respectively formed with two fitting holes communicating with the insertion hole.

12. Ratchet socket as claimed in claim 11, wherein the two fitting holes have identical sizes.

13. Ratchet mechanism as claimed in claim 1, wherein two ends of the main body are respectively equipped with two ratchet mechanisms having reverse driving directions, the ratchet wheel of each ratchet mechanism being formed with a polygonal fitting hole, a driving section being disposed on the main body.

14. Ratchet socket as claimed in claim 13, wherein the interior of the main body is formed with an insertion hole between the two ratchet mechanisms, the insertion hole communicating with the fitting holes and serving as the driving section for a tool to insert therein.

15. Ratchet socket as claimed in claim 13, wherein the driving section is polygonal and disposed on outer circumference of the main body for a tool to hold.

16. Ratchet socket as claimed in claim 1, wherein the outer circumference of the main body is formed with an annular groove in which the resilient hoop is inlaid.

* * * * *